US008074675B2

(12) United States Patent
Thomas et al.

(10) Patent No.: US 8,074,675 B2
(45) Date of Patent: Dec. 13, 2011

(54) FAUCET HANDLE MOUNTING

(75) Inventors: Kurt Judson Thomas, Indianapolis, IN (US); Brian Jolliffe, Carmel, IN (US); Dan Zendzian, Marietta, GA (US)

(73) Assignee: Masco Corporation of Indiana, Indianapolis, IN (US)

( * ) Notice: Subject to any disclaimer, the term of this patent is extended or adjusted under 35 U.S.C. 154(b) by 202 days.

(21) Appl. No.: 12/427,523

(22) Filed: Apr. 21, 2009

(65) Prior Publication Data

US 2009/0205719 A1 Aug. 20, 2009

Related U.S. Application Data

(62) Division of application No. 10/831,814, filed on Apr. 26, 2004, now Pat. No. 7,540,300.

(51) Int. Cl.
*E03C 1/04* (2006.01)

(52) U.S. Cl. ..... 137/359; 4/678

(58) Field of Classification Search ..... 137/359; 4/675, 676, 678

See application file for complete search history.

(56) References Cited

U.S. PATENT DOCUMENTS

| | | | | |
|---|---|---|---|---|
| 2,898,776 | A | 8/1959 | Spencer | |
| 2,966,924 | A | 1/1961 | Young | |
| 3,301,580 | A | 1/1967 | Meyer | |
| 3,556,140 | A | 1/1971 | Politz | |
| 3,680,592 | A * | 8/1972 | Hayman | 137/625.4 |
| 4,479,736 | A | 10/1984 | Evans et al. | |
| 4,662,389 | A | 5/1987 | Igbal | |
| 4,739,788 | A | 4/1988 | Reback | |
| 4,842,009 | A | 6/1989 | Reback | |
| 4,876,766 | A | 10/1989 | Cohen | |
| 4,961,443 | A | 10/1990 | Buccicone et al. | |
| 5,257,645 | A | 11/1993 | Scully et al. | |
| 5,388,287 | A | 2/1995 | Tischler | |
| 5,421,520 | A | 6/1995 | Simonette et al. | |
| 5,458,154 | A | 10/1995 | Niemann et al. | |
| 5,797,422 | A | 8/1998 | Tokarz | |
| 5,826,788 | A | 10/1998 | Redding | |
| 5,933,916 | A | 8/1999 | Loschelder | |
| 5,947,149 | A | 9/1999 | Mark | |
| 6,195,840 | B1 | 3/2001 | Pilatowicz et al. | |
| 6,279,604 | B1 | 8/2001 | Korb et al. | |
| 6,438,771 | B1 | 8/2002 | Donath, Jr. et al. | |
| 6,666,227 | B2 | 12/2003 | Erickson | |
| 2002/0053361 | A1 | 5/2002 | Buchner et al. | |

OTHER PUBLICATIONS

Delta Faucet Co. Maintenance and Installation Sheets—Models 2155 Series, Two Handle Bar Faucets (Sep. 25, 2001).

Delta Faucet Co. Maintenance and Installation Sheets—Models 3560 & 3565, Two Handle Widespread Lavatory Faucets (Aug. 5, 2003).

Delta Faucet Co. Maintenance and Installation Sheets—Models 2500, 2502, 2520, 2521, 2522, 2530 & 2567, Two Handle Lavatory Centerset Faucets (Sep. 3, 2002).

Delta Faucet Co. Maintenance and Installation Sheets—Models 4555, Two Handle Mini-Widespread Lavatory Faucets (Jan. 26, 2001).

Delta Faucet Co. drawings showing a partial cross-section of a prior art faucet, at least as early as Apr. 26, 2004.

* cited by examiner

*Primary Examiner* — Stephen M Hepperle
*Assistant Examiner* — Kevin Murphy
(74) *Attorney, Agent, or Firm* — Baker & Daniels LLP

(57) ABSTRACT

A faucet handle assembly configured to couple to a valve stem extending outwardly from an escutcheon. The faucet handle assembly includes a handle base axially adjustable along a longitudinal axis of the valve stem. A glide surface is supported by the handle base and is configured to contact an outer surface of the escutcheon.

19 Claims, 5 Drawing Sheets

FAUCET HANDLE MOUNTING

CROSS-REFERENCE TO RELATED APPLICATION

The present application is a divisional application of U.S. patent application Ser. No. 10/831,814, filed Apr. 26, 2004 now U.S. Pat. No. 7,540,300, the disclosure of which is incorporated by reference herein.

BACKGROUND AND SUMMARY OF THE INVENTION

The present invention relates to a faucet handle assembly and, more particularly, to a faucet handle assembly which is configured to eliminate a gap between a handle base and a corresponding mounting base or escutcheon.

Conventional faucets typically include at least one faucet handle assembly which is rotated to open and close a valve for controlling the flow of water to a delivery spout. More particularly, the faucet handle assembly is coupled to the valve stem of a valve cartridge. The faucet handle assembly is typically located above a mounting base or escutcheon, which is supported on a sink deck. A clearance gap generally exists between a conventional faucet handle assembly and the escutcheon. The clearance gap serves as a tolerance buffer for dimensional variations of components. The clearance gap is generally achieved by positioning a stop within the faucet handle assembly. The stop is configured to engage the valve stem and thereby prevent axial travel of the faucet handle assembly beyond a certain point along the valve stem. The clearance gap between the faucet handle assembly and the escutcheon may be aesthetically unpleasant, depending upon the particular design of the handle assembly, and may provide a location for the collection of dirt and debris.

The faucet handle assembly according to an illustrative embodiment of the present invention is configured to couple to a valve stem of a valve, the valve stem extending outwardly from an escutcheon. The faucet handle assembly comprises a handle base configured to be coupled to the valve stem and to be axially adjusted along a longitudinal axis of the valve stem, the handle base including a first end and a second end. A handle is coupled to the first end of the handle base such that movement of the handle is configured to rotate the handle base and the valve stem about the longitudinal axis, thereby causing the second end of the handle base to move relative to the escutcheon. A non-metallic glide surface is supported by the second end of the handle base and faces an outer surface of the escutcheon. The glide surface is configured to contact the outer surface of the escutcheon and to provide for relative movement between the handle base and the escutcheon.

Illustratively, a locking device is operably coupled to the handle base and the valve stem, and is configured to secure the handle base from moving axially relative to the valve stem. The locking device illustratively comprises a planar portion formed on the valve stem and a set screw extending perpendicularly to the planar portion, the set screw extending through the handle base and engaging the planar portion of the valve stem. The locking device is further illustratively configured to secure the handle base from rotating relative to the valve stem. Illustratively, the locking device comprises a receiving bore formed within the handle base and having a D-shaped cross-section. The valve stem includes a portion have a cooperating D-shaped cross-section configured to be received within the receiving bore.

Illustratively, the glide surface is an outer surface of a glide ring coupled to the second end of the handle base. The glide ring illustratively includes a plurality of locking tabs, and the second end of the handle base includes an annular lip, the locking tabs being configured to secure the glide ring to the annular lip.

According to a further illustrative embodiment of the present invention, a faucet comprises a mounting base including an opening and an upwardly facing surface, and a valve including a valve stem with an upper end positioned above the opening of the mounting base. A handle base includes an upper end and an open lower end, the open lower end being configured to receive the valve stem. A glide ring is supported by the lower end of the handle base, the glide ring including a downwardly facing glide surface configured to contact the upwardly facing surface of the mounting base and to provide for relative movement between the handle base and the mounting base.

In yet another illustrative embodiment of the present invention, a faucet handle assembly is configured to couple to a valve stem of a valve, the valve stem having an upper end positioned above an opening of an escutcheon. The faucet handle assembly comprises a handle base including a first end, a second end, and a cavity extending upwardly from the second end toward the first end. The cavity of the handle base is configured to receive the valve stem. The faucet handle assembly further comprises means for selectively adjusting the handle base along an axis of the valve stem, and means for closing the space between the second end of the handle base and an outer surface of the escutcheon, while permitting movement of the handle base relative to the escutcheon.

Additional features and advantages of the present invention will become apparent to those skilled in the art upon consideration of the following detailed description of the illustrative embodiment exemplifying the presently perceived best mode of carrying out the invention.

BRIEF DESCRIPTION OF THE DRAWINGS

The detailed description of the drawings particularly refers to the accompanying figures in which.

DETAILED DESCRIPTION OF THE DRAWINGS

While in the following detailed description the present invention will be described in connection with a faucet for use with a sink, it should be understood that the faucet handle assembly of the present invention may be utilized in connection with any conventional water flow control valve, including those for use with showers or tubs. Furthermore, the particular exterior shape or appearance of the faucet handle assembly and escutcheon may be selected by the end user based upon a number of factors, including aesthetic considerations. More particularly, the coupling of the faucet handle assembly to the valve permits for the faucet handle assembly to be interchanged with a different faucet handle assembly having a different decorative appearance.

Figure 1:
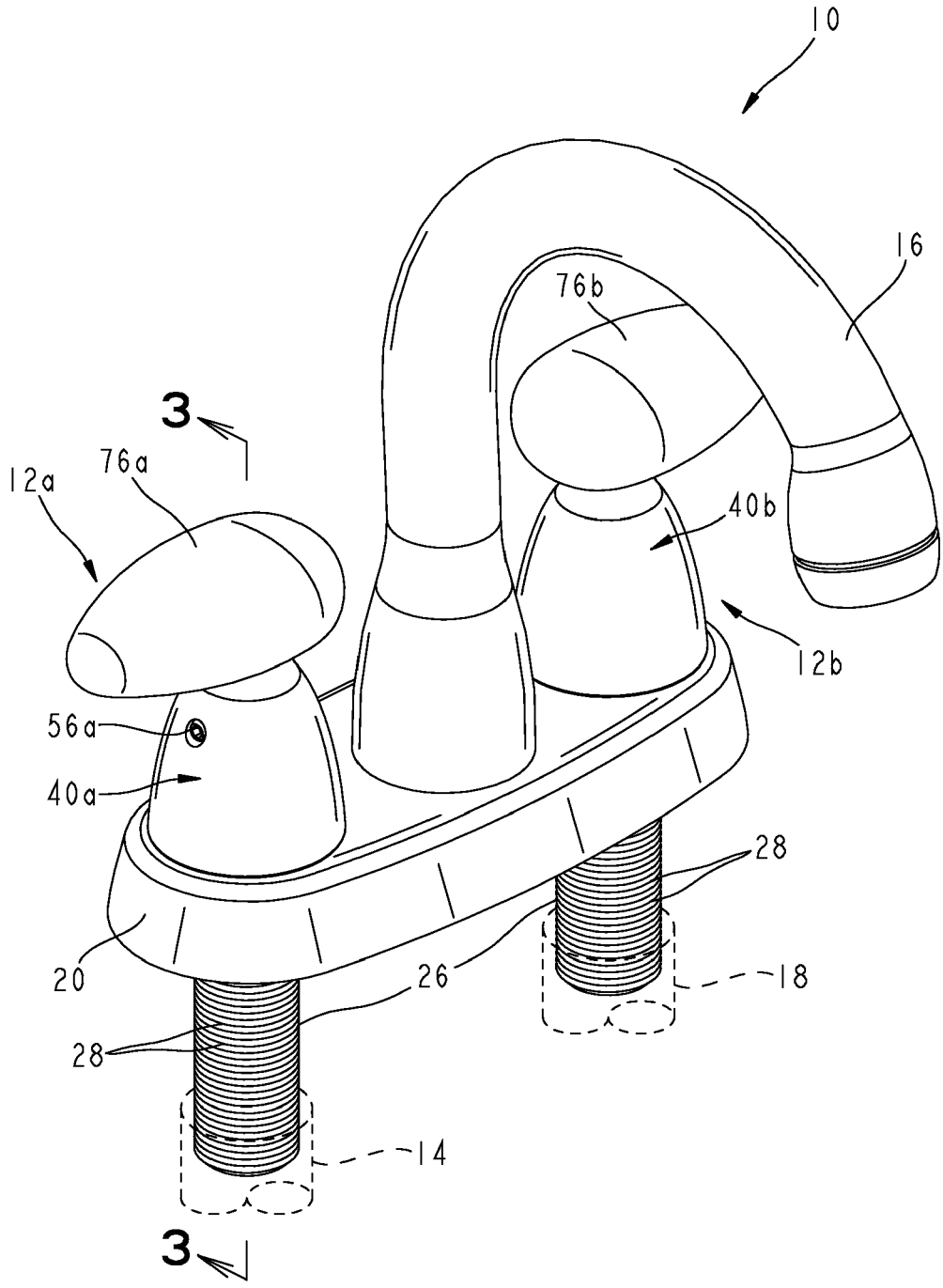
FIG. 1 is a perspective view of a faucet including a faucet handle assembly of the present invention.
Figure 2:
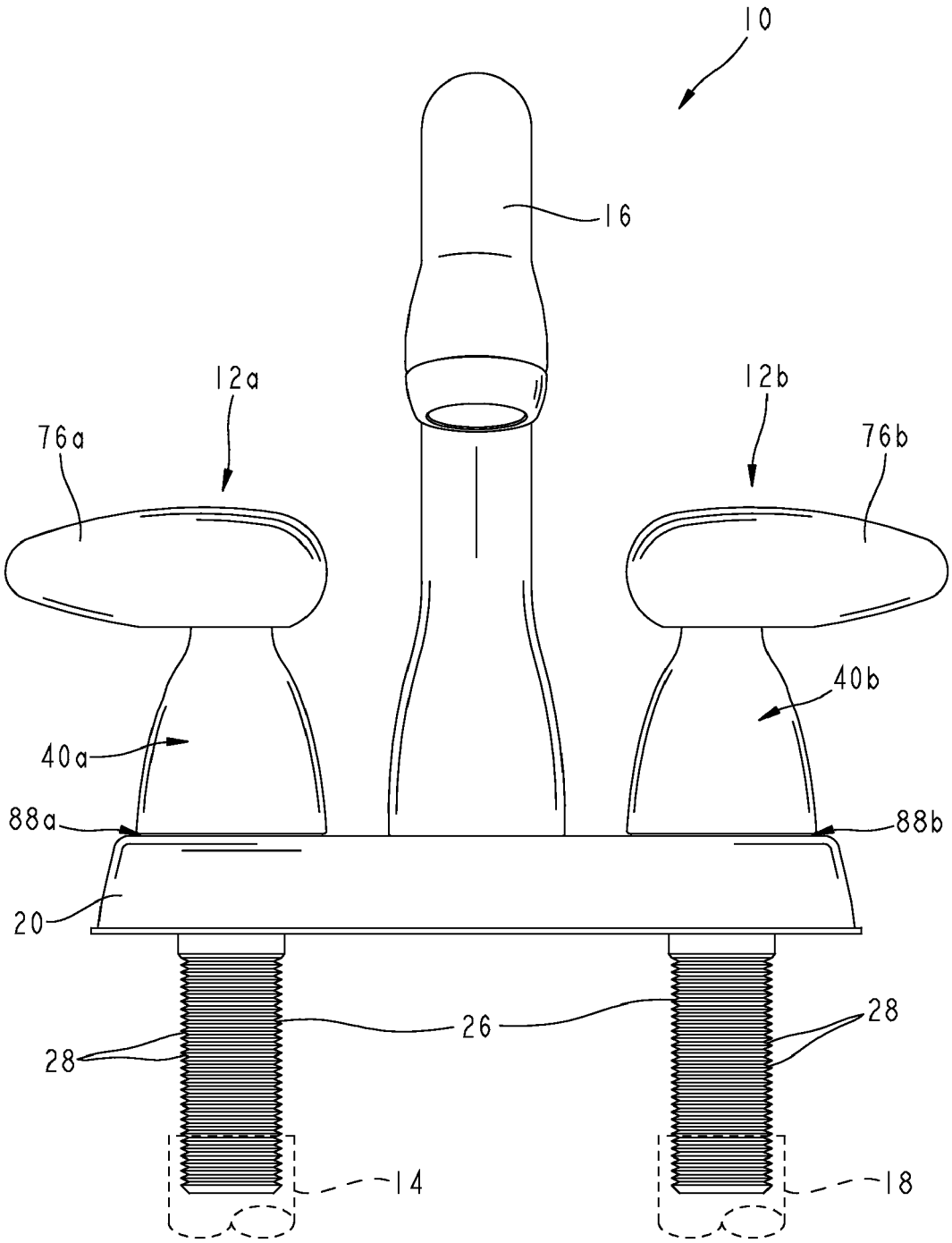
FIG. 2 is a front elevation view of the faucet of FIG. 1.

With reference initially to FIGS. 1 and 2 of the drawings, an illustrative faucet 10 is shown as including first and second faucet handle assemblies 12*a* and 12*b* of the present invention. Rotation of the first faucet handle assembly 12*a* controls the flow of hot water supplied from a hot water supply line 14 to a delivery spout 16. Similarly, rotation of the second faucet handle assembly 12*b* controls the flow of cold water supplied from a cold water supply line 18 to the delivery spout 16. While the following description references details of the first faucet handle assembly 12*a*, it should be appreciated that the second faucet handle assembly 12*b* is substantially identical. As such, like components will be identified with the same reference numeral followed by the letter "a" when referring to the first faucet handle assembly 12*a*, and followed by the letter "b" when referring to the second faucet handle assembly 12*b*.

Figure 3:
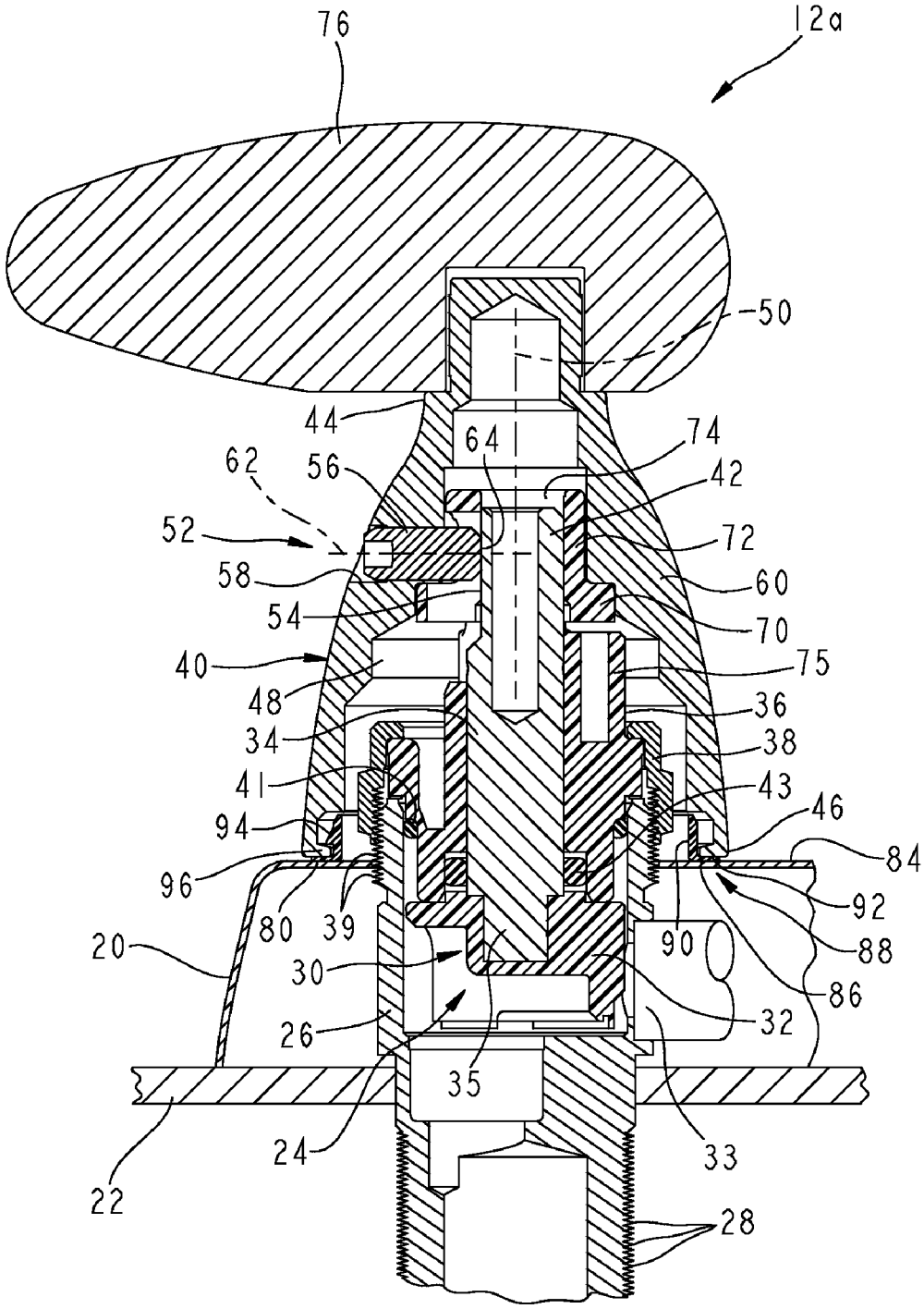
FIG. 3 is a cross-sectional view taken along line 3-3 of FIG. 1, illustrating the escutcheon, the valve, and the faucet handle assembly of the present invention.

With further reference to FIGS. 1-3, the first and second faucet handle assemblies 12*a* and 12*b* and the delivery spout 16 are positioned above a mounting base or escutcheon 20. The escutcheon 20 is supported by a sink deck 22 (FIG. 3) in a conventional manner and is illustratively formed of a metal, such as brass. A conventional valve 24 is operably coupled with each supply line 14 and 18 in order to control the flow of water to the delivery spout 16. The valve 24 may be of conventional design and include a valve body 26 having lower external threads 28 to facilitate coupling with the respective water supply line 14, 18.

Figure 4:
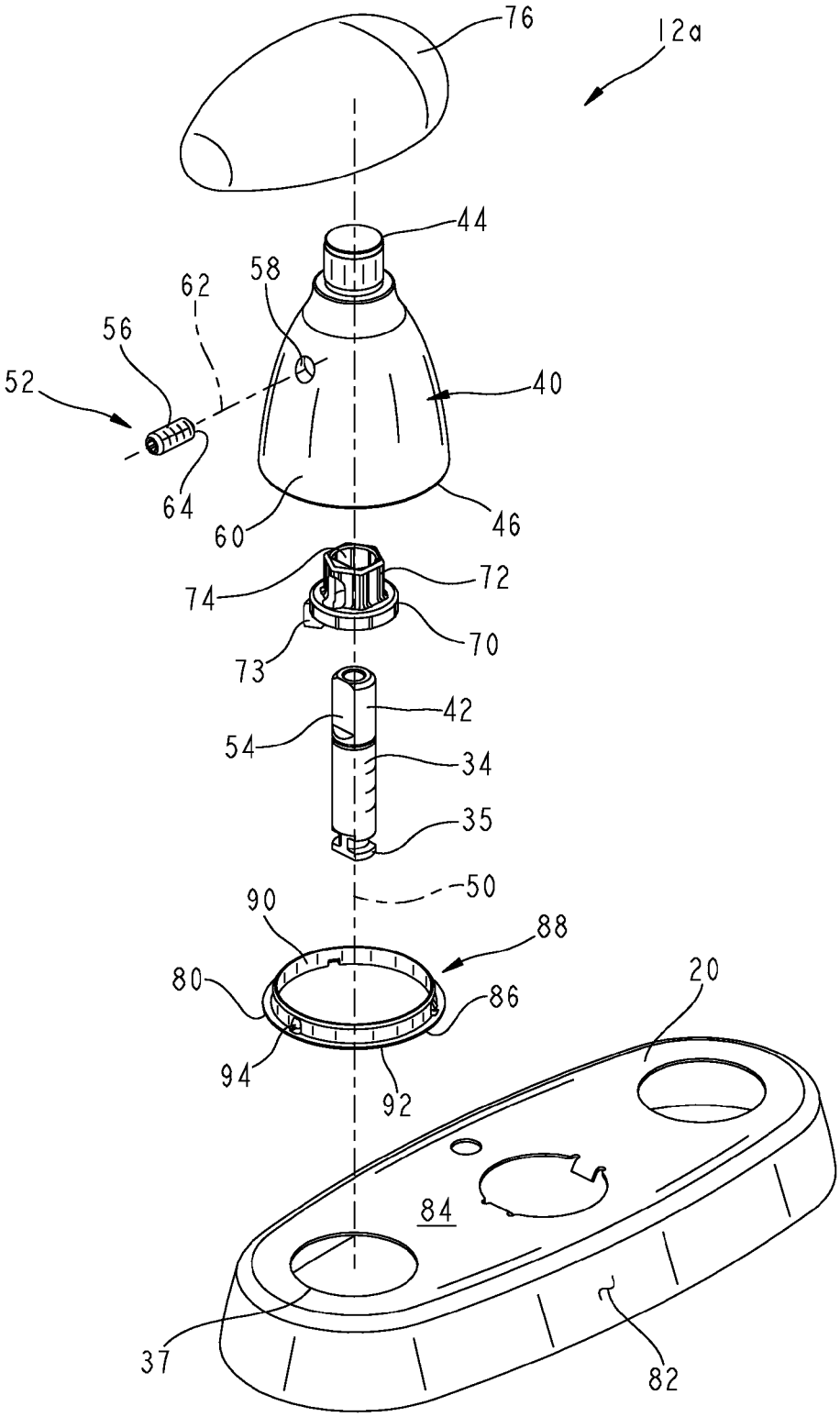
FIG. 4 is an exploded perspective view of the escutcheon and the faucet handle assembly of the present invention.

Referring now to FIGS. 3 and 4, a valve cartridge 30 is supported within the valve body 26 and includes a rotatable valve member 32 configured to control the flow of water passing through an outlet 33, which is in fluid communication with the delivery spout 16. A valve stem 34 includes a lower portion or end 35 coupled to the valve member 32 and is illustratively formed of a metal, such as brass. The lower end 35 of the valve stem 34 may be coupled to the valve member 32 in a conventional manner, for example, through an interference fit or spline connection. The valve body 26, including the valve stem 34, extends through an opening 37 (FIG. 4) formed within the escutcheon 20. A bushing 36 is coupled to the valve body 26 by an internally threaded nut or bonnet 38, which threadably receives upper external threads 39 of the valve body 26. A first o-ring 41 provides a seal between the valve body 26 and the bushing 36, while a second o-ring 43 provides a seal between the bushing 36 and the valve stem 34. The valve stem 34 is supported for rotational movement within the bushing 36. The bushing 36 is illustratively formed of a non-metallic material, such as a thermoplastic, to promote rotation between the bushing 36 and the valve stem 34 and to prevent excessive wear. As is known, rotation of the valve stem 34 causes rotation of the valve member 32 in order to control the flow of water through the valve body 26.

A handle base 40 is operably coupled to an upper portion or end 42 of the valve stem 34. In the illustrative embodiment, the handle base 40 includes a first or upper end 44 and a second or lower end 46. The lower end 46 opens into a cavity 48 (FIG. 3) extending upwardly from the lower end 46 toward the upper end 44. Illustratively, the handle base 40 is formed of a metal, such as brass.

The handle base 40 is selectively adjustable along a longitudinal axis 50 of the valve stem 34. A locking device 52 is operably coupled to the handle base 40 and the valve stem 34, and is configured to secure the handle base 40 axially (i.e., along the longitudinal axis 50) relative to the valve stem 34. Illustratively, the locking device 52 comprises a planar portion or flat section 54 formed on an outer surface of the valve stem 34. A set screw 56 extends radially inwardly from the handle base 40 and is configured to engage the planar portion 54. More particularly, the set screw 56 is threadably received within an opening 58 formed within an outer wall 60 of the handle base 40. The set screw 56 is aligned on a horizontal axis 62 such that a tip 64 of the set screw 56 is oriented perpendicular to the longitudinal axis 50 of the valve stem 34. The planar portion 54 of the valve stem 34 is illustratively made of the material softer than that of the set screw 56 such that the set screw 56 will indent or "bite" into the planar portion 54. This indentation after tightening prevents the unintentional removal of the handle base 40 under an axial load. As noted above, the valve stem 34, including planar portion 54, may be formed of brass while the set screw 56 may be formed of a hardened steel. The planar portion 54 of the valve stem 34 together with the set screw 56 provides for the vertical adjustment of the handle base 40 such that dimensional tolerances of the various components of the handle assembly 12 may be absorbed.

An insert 70 may be received within the cavity 48 of the handle base 40. Illustratively, the insert 70 has a body 72 defining a receiving bore 74. The receiving bore 74 illustratively includes a D-shaped cross section which is configured to receive the upper portion 42 of the valve stem 34, which has a cooperating D-shaped cross section as defined by the planar portion 54. As such, the receiving bore 74 and upper end 42 of the valve stem 34 comprise part of the locking device 52 and are configured to secure the handle base 40 from rotating relative to the valve stem 34. Illustratively, the insert 70 is formed of a thermoplastic material. The body 72 may include a rotational or angular stop member 73 configured to selectively engage a cooperating extension 75 of the bushing 36 for limiting the angle of rotation of the handle base 40 and the valve stem 34. While in the illustrative embodiment the receiving bore 74 and the stop member 73 are formed by the insert 70, it should be appreciated that the insert 70 could be formed integral with the handle base 40. More particularly, the receiving bore 74 and the stop member 73 could be formed through conventional means, such as casting or machining, within the cavity 48 of the handle base 40.

A handle 76 is illustratively coupled to the upper end 44 of the handle base 40. While the handle 76 is illustrated as a lever in the figures, it should be appreciated that the handle 76 may be of any desired shape or size. Further, the handle 76 may be coupled to the handle base 40 in any conventional manner, for example, by a threaded connection, a friction fit, or conventional adhesives. Additionally, the handle 76 may be integrally formed with the handle base 40.

Figures 5, 6, 7:
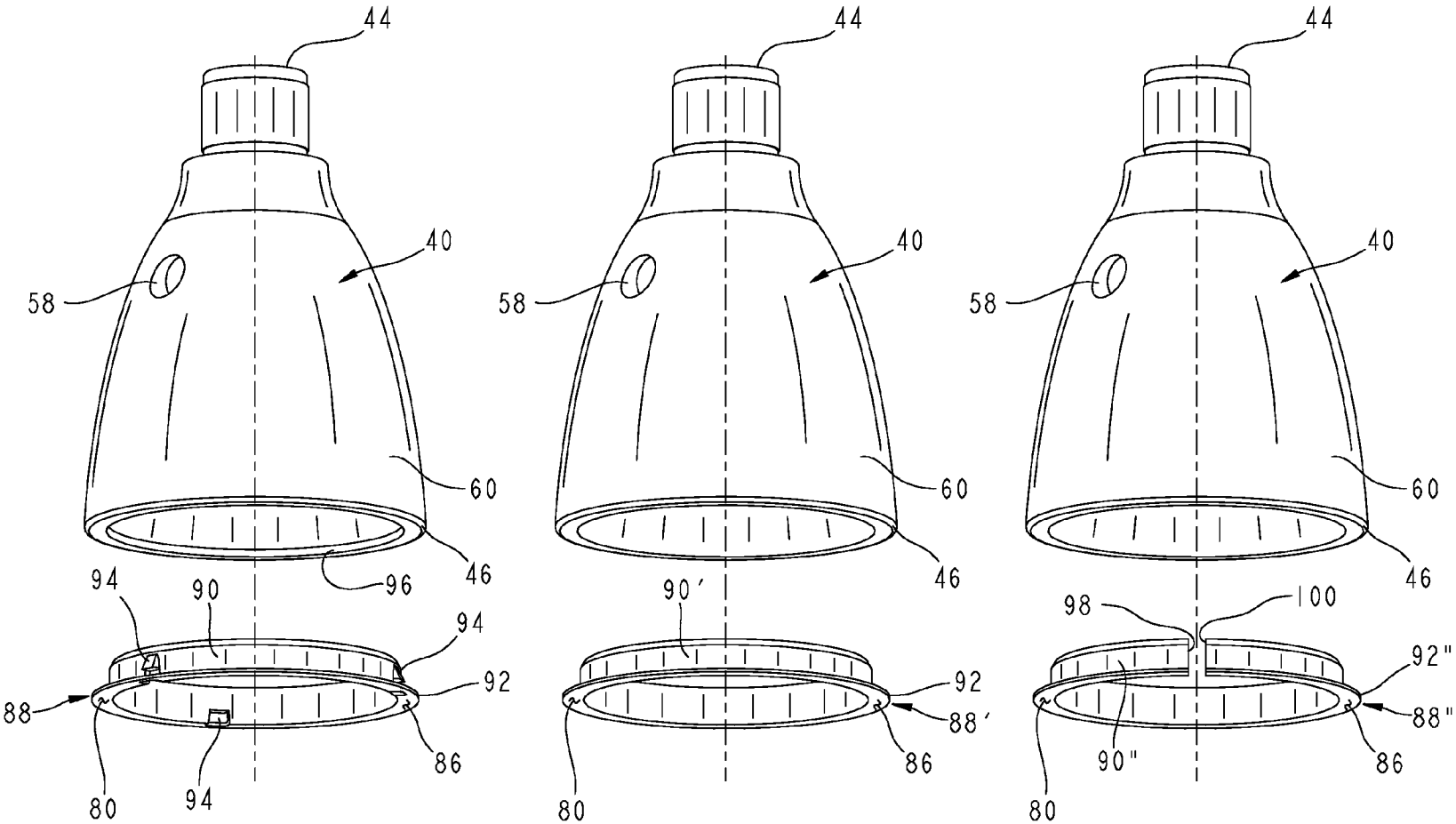
FIG. 5 is a perspective view of the handle base and a first embodiment glide ring of the present invention.
FIG. 6 is a perspective view of the handle base and a second embodiment glide ring of the present invention.
FIG. 7 is a perspective view of the handle base and a third embodiment glide ring of the present invention.

With reference now to FIGS. 4-7, a glide surface 80 is supported by the lower end 46 of the handle base 40. The glide surface 80 faces an outer surface 82, illustratively an upper surface 84, of the escutcheon 20 and provides for relative movement between the handle base 40 and the escutcheon 20. The glide surface 80 is illustratively a downwardly facing surface 86 of a glide ring 88 coupled to the lower end 46 of the handle base 40 (FIGS. 5-7). The glide ring 88 is formed from a non-metallic material, illustratively a thermoplastic, and prevents direct contact between the lower end 46 of the handle base 40 and the upper surface 84 of the escutcheon 20.

As illustrated in FIG. 5, in one illustrative embodiment, the glide ring 88 includes an upper or retaining portion 90 and a lower or flange portion 92. The upper portion 90 includes a plurality of circumferentially spaced resilient locking tabs 94 configured to couple to an annular lip 96 concentrically formed within and extending inwardly from the outer wall 60 of the handle base 40. The annular lip 96 is secured between the locking tabs 94 and the lower portion 92 of the glide ring 88.

As illustrated in FIG. 6, a second embodiment glide ring 88' includes an upper or retaining portion 90' which is frictionally fit within the lower end 46 of the handle base 40. FIG. 7 illustrates a third embodiment glide ring 88" which comprises a split ring including an upper or retaining portion 90" and a lower or flange portion 92", both portions 90" and 92" defining opposing ends 98, 100 which are spring biased within the lower end 46 of the handle base 40 for retention therein.

To assemble the faucet handle assembly 12 to the valve stem 34 and in contact with the escutcheon 20, the installer initially verifies that the glide ring 88 is secured to the handle base 40. If not, then the glide ring 88 is simply inserted into the open lower end 46 of the handle base 40 such that the locking tabs 94 couple to the annular lip 96. Next, the installer verifies that the set screw 56 is positioned to prevent interference with the valve stem 34. The lower end 46 of the handle base 40 is then placed over the valve stem 34 and is angularly oriented so that the D-shaped cross section of the receiving bore 74 of the insert 70 is aligned with the upper portion 42 of the valve stem 34. Once in the proper angular orientation, the handle base 40 is lowered until the glide surface 80 of the glide ring 88 contacts the upper surface 84 of the escutcheon 20, thereby eliminating any gap between the handle base 40 and the escutcheon 20. After being placed in the proper axial position, the set screw 56 is rotated or tightened until the tip 64 engages and indents the planar portion 54 of the valve stem 34.

The set screw 56 used for attachment of the handle base 40 to the valve stem 34 does not generate any vertical load on the faucet handle assembly 12 since it is positioned on horizontal axis 62. The lack of vertical load allows the faucet handle assembly 12 to rest on the escutcheon 20 while being tightened and will not cause any undue binding on the valve 24. Because the valve stem 34 does not have a vertically orienting feature for engagement with the set screw 56, the placement of the set screw 56 only depends upon the overall height of the individual components that make up the faucet handle assembly 12. If enough planar portion 54 is provided on the valve stem 34, the part to part variation of the entire faucet handle assembly 12 can be absorbed and the assembly 12 will always sit directly on the escutcheon 20. The glide ring 88 between the lower end 46 of the handle base 40 and the outer surface 82 of the escutcheon 20 facilitates rotational movement between the faucet handle assembly 12 and the escutcheon 20. More particularly, the glide ring 88 isolates the lower end 46 of the handle base 40 from the upper surface 84 of the escutcheon 20, thereby preventing noise and finish damage due to rotational movement of the faucet handle assembly 12. Further, the glide ring 88 provides an aesthetically pleasing look and an easy to clean interface between the handle base 40 and the escutcheon 20.

Although the invention has been described in detail with reference to certain preferred embodiments, variations and modifications exist within the spirit and scope of the invention as described and defined in the following claims.

The invention claimed is:

1. A faucet including:

a mounting base including an opening and an upwardly facing surface;

a valve including a valve body, a valve stem having an upper end positioned above the opening of the mounting base, and a bonnet operably coupling the valve stem to the valve body;

a handle base including an upper end and an open lower end, the open lower end including a cavity configured to receive the valve stem; and a glide ring coupled to the lower end of the handle base and configured to move axially with the handle base, the glide ring including a retaining surface received within the cavity of the handle base and conforming to an inner surface of the handle base, and including a downwardly facing glide surface contacting the upwardly facing surface of the mounting base and including an upper surface contacting the handle base to provide for relative movement between the handle base and the mounting base, while filling an axial clearance gap between the handle base and the mounting base such that the handle base and the mounting base are in axially spaced relation thereby preventing contact between the upwardly facing surface of the mounting base and the lower end of the handle base, the glide ring further including an annular upper portion concentrically received within the open lower end of the handle base, and an annular lower portion positioned below the lower end of the handle base and including the downwardly facing glide surface, the upper portion of the glide ring supporting a plurality of locking tabs and the lower end of the handle base includes an annular lip, the annular lip configured to be secured between the locking tabs and the lower portion of the glide ring.

2. The faucet of claim 1, wherein the handle base is configured to be selectively moved along a longitudinal axis of the valve stem.

3. The faucet of claim 2, further comprising a locking device operably coupled to the handle base and the valve stem, the locking device configured to secure the handle base from moving along the longitudinal axis of the valve stem.

4. The faucet of claim 3, wherein the locking device comprises a planar portion formed on the valve stem and a set screw extending perpendicular to the planar portion, the set screw extending through the handle base and configured to engage the planar portion of the valve stem.

5. The faucet of claim 3, wherein the locking device is further configured to secure the handle base from rotating relative to the valve stem.

6. The faucet of claim 1, further comprising an insert concentrically received within the handle base, the insert including a receiving bore having a D-shaped cross-section configured to receive the upper end of the valve stem, the upper end of the valve stem having a D-shaped cross-section.

7. The faucet of claim 1, further comprising a stop supported by the handle base and configured to limit rotation of the handle base and the valve stem.

8. The faucet of claim 1, wherein the glide ring is formed of a thermoplastic material.

9. The faucet of claim 1, further comprising a handle coupled to the upper end of the handle base.

10. The faucet handle assembly of claim 1, wherein the glide ring further includes outwardly extending retaining surfaces that engage the cavity of the handle base.

11. A faucet handle assembly configured to couple to a valve stem of a valve, the valve stem having an upper end positioned above an opening of an escutcheon and being operably coupled to a valve body by a bonnet, the faucet handle assembly comprising:

a handle base including a first end, a second end, and a cavity extending from the second end toward the first end, the cavity including an annular lip, the cavity of the handle base positioned above the escutcheon and configured to receive the valve stem and the bonnet;

means for selectively adjusting and locking the handle base along an axis of the valve stem;

means for engaging the second end of the handle base cavity via the lip and an outer surface of the escutcheon and for closing the space between the second end of the handle base and the outer surface of the escutcheon while permitting movement of the handle base relative to the escutcheon, while preventing contact between the handle base and the escutcheon; and means for coupling the engaging means to the second end of the handle base thereby restraining axial and radial movement of the engaging means relative to the handle base.

12. The faucet handle assembly of claim 11, wherein the means for selectively adjusting the handle base comprises a planar portion formed on the valve stem and a set screw extending perpendicular to the planar portion, the set screw extending through the handle base and configured to indent the planar portion of the valve stem.

13. The faucet handle assembly of claim 11, wherein the means for closing the space between the second end of the handle base and the outer surface of the escutcheon comprises a glide ring concentrically supported by the second end of the handle base, the glide ring including a glide surface facing and configured to contact the outer surface of the escutcheon.

14. The faucet handle assembly of claim 13, wherein the glide ring includes an annular upper portion concentrically received within the cavity of the handle base, and an annular lower portion positioned below the second end of the handle base and including the glide surface.

15. A faucet handle assembly configured to couple to a valve stem of a valve, the valve stem extending outwardly from an escutcheon, the faucet handle assembly comprising:

a handle base configured to be coupled to the valve stem, the handle base including a first end and a second end, the second end including an annular lip;

a handle coupled to the first end of the handle base such that movement of the handle is configured to rotate the handle base and the valve stem about the longitudinal axis, thereby causing the second end of the handle base to move relative to the escutcheon; and a glide ring coupled to move axially with the handle base and including a retaining portion concentrically received within the lip of the second end of the handle base and a flange portion having a non-metallic glide surface extending radially outwardly from the retaining portion and facing an outer surface of the escutcheon, the glide surface extending transversely within a clearance gap defined intermediate the second end of the handle base and the escutcheon, the glide surface configured to contact the outer surface of the escutcheon and to provide for relative movement between the handle base and the escutcheon, while preventing contact between the handle base and the escutcheon.

16. The faucet handle assembly of claim 15, wherein the glide surface is recessed radially inwardly relative to the first end of the handle base.

17. The faucet of claim 10, wherein the cavity base has surfaces that are complementary to the retaining surfaces of the glide ring.

18. The faucet of claim 10, wherein the retaining surfaces include multiple distinct retaining surfaces located at regular intervals around the glide ring.

19. The faucet of claim 10, wherein the glide ring is frictionally retained within the cavity of the handle base.

* * * * *